US006550269B2

(12) United States Patent
Rudick

(10) Patent No.: US 6,550,269 B2
(45) Date of Patent: Apr. 22, 2003

(54) DISPENSING APPARATUS WITH DIRECTIONAL LED LIGHTING

(75) Inventor: Arthur G. Rudick, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 10/047,354

(22) Filed: Jan. 14, 2002

(65) Prior Publication Data

US 2002/0056287 A1 May 16, 2002

Related U.S. Application Data

(63) Continuation-in-part of application No. 09/504,702, filed on Feb. 16, 2000.

(51) Int. Cl.[7] ..... F25D 11/00

(52) U.S. Cl. ..... 62/440; 362/154

(58) Field of Search ..... 62/440, 264; 221/124, 221/132, 281, 150 R; 362/101, 800, 253, 154, 318, 96

(56) References Cited

U.S. PATENT DOCUMENTS

| | | | | |
|---|---|---|---|---|
| 3,471,210 A | | 10/1969 | Barroero | 312/329 |
| 3,831,807 A | * | 8/1974 | Deaton et al. | 221/85 |
| 4,146,883 A | * | 3/1979 | Appeldorn et al. | 313/500 |
| 4,240,563 A | * | 12/1980 | Lennartson | 221/242 |
| 4,284,207 A | * | 8/1981 | Christian | 221/90 |
| 4,318,485 A | | 3/1982 | Clement | 211/49 D |
| 4,646,528 A | * | 3/1987 | Marcade et al. | 236/94 |
| 4,928,853 A | * | 5/1990 | Isham et al. | 222/108 |
| 4,977,754 A | | 12/1990 | Upton et al. | 221/150 R |
| 5,284,022 A | * | 2/1994 | Chung | 62/434 |
| 5,392,953 A | * | 2/1995 | Maldanis et al. | 211/59.2 |
| 5,445,287 A | | 8/1995 | Center et al. | 221/150 R |
| D367,864 S | | 3/1996 | Lacewell | D15/85 |
| 5,520,450 A | * | 5/1996 | Colson et al. | 312/215 |
| 5,567,026 A | | 10/1996 | Lacewell | 312/135 |
| 5,575,459 A | * | 11/1996 | Anderson | 313/318.03 |
| D377,800 S | | 2/1997 | Branz et al. | D15/85 |
| D383,796 S | | 9/1997 | Rinicella et al. | D20/42 |
| 5,706,957 A | | 1/1998 | Hardy | 211/59.2 |
| 5,772,072 A | * | 6/1998 | Prescott et al. | 221/121 |
| D395,968 S | | 7/1998 | Shappell | D6/509 |
| 5,820,246 A | * | 10/1998 | Helstern | 362/800 |
| 5,823,390 A | * | 10/1998 | Muderlak et al. | 222/333 |
| D402,138 S | | 12/1998 | Trulaske, Sr. | D6/470 |
| 5,967,367 A | | 10/1999 | Orsborn | 222/30 |
| 6,079,216 A | | 6/2000 | de Marsillac Plunket | 62/56 |
| 6,131,399 A | | 10/2000 | Hall | 221/150 R |

FOREIGN PATENT DOCUMENTS

| | | | |
|---|---|---|---|
| DE | 298 03 105 | | 7/1998 |
| EP | 0 903 549 | | 3/1999 |
| WO | WO 91/07641 | * | 5/1991 |
| WO | WO 01/00065 | | 4/2001 |

* cited by examiner

*Primary Examiner*—William C. Doerrler
*Assistant Examiner*—Mohammad M. Ali
(74) *Attorney, Agent, or Firm*—Sutherland Asbill & Brennan LLP

(57) ABSTRACT

A device for providing a number of products. The device may include an enclosure and a number of directional light emitting diodes positioned within the enclosure for illuminating the products.

26 Claims, 5 Drawing Sheets

DISPENSING APPARATUS WITH DIRECTIONAL LED LIGHTING

RELATED APPLICATIONS

The present application is a Continuation-in-Part of Ser. No. 09/504,702, filed on Feb. 16, 2000, now allowed.

TECHNICAL FIELD

The present invention relates generally to a dispensing apparatus, such as a vending machine, a cooler, a glass front merchandiser, and the like, and more particularly relates to a dispensing apparatus with light emitting diode ("LED") lighting sources.

BACKGROUND OF THE INVENTION

The design and the construction of a dispensing apparatus may focus on the sometimes conflicting goals of (1) how effectively the apparatus markets the products therein and (2) how efficient the apparatus may be in terms of energy consumption. By product marketing, we mean that the dispensing apparatus and the products therein should be visually appealing so as to catch the eye of the consumer. The products therein preferably can be easily seen and identified. By energy efficiency, we mean that the energy usage of the apparatus should be reasonable with respect to the desired cooling load and any other desired functions of the apparatus, such as product marketing.

These conflicting goals, however, may not be easily reconciled. For example, the energy costs involved in effectively lighting a dispensing apparatus at all times may be extensive. Conversely, insufficient lighting or the inability of the apparatus to catch and keep the eye of the consumer may affect desired sales levels.

What is desired, therefore, is a dispensing apparatus that adequately illuminates and promotes the products therein while being reasonable in terms of energy usage. These competing goals should be accomplished in an apparatus that is reasonable in terms of the cost of manufacture and the cost of usage.

SUMMARY OF THE INVENTION

The present invention thus provides a device for providing a number of products. The device may include an enclosure and a number of directional light emitting diodes positioned within the enclosure for illuminating the products.

Specific embodiments of the invention may include the directional light emitting diodes having a directivity of about twenty (20) degrees and a luminous intensity of about five (5) to six (6) Candela, with about 5.6 Candela preferred. The enclosure may include a number of shelves, a doorframe, and one or more mounting blocks. The directional light emitting diodes may be positioned on the shelves, on the doorframe, and/or on the mounting blocks. The products may each include an indication of source. The directional light emitting diodes may be directed at the indication of source. The directional light emitting diodes may be adjustable. The device may further include a number of light emitting diodes and a florescent light source.

A further embodiment of the present invention may provide a dispensing device for a number of products. The device may include an enclosure, a heat transfer system positioned in communication with the enclosure, and a number of light emitting diodes positioned in communication with the enclosure to illuminate the products. The heat transfer system may include a Stirling cycle device. The light emitting diodes may be in the form of light emitting diode bundles. The light emitting diodes may have a brightness of about 1000 to about 3000 Lumens. The enclosure may have a number of shelves. The shelves may include gravity feed slides, rotating coils, or drop mechanisms. The device also may include a fluorescent light source positioned within the enclosure.

A further embodiment of the present invention may provide a dispensing device for a number of products. The device may include an enclosure with a transparent panel, a vending mechanism positioned in communication with the enclosure, and a number of light emitting diodes positioned within the enclosure to illuminate the products. The light emitting diodes may be in the form of light emitting diode bundles or in the form of directional light emitting diodes. The device also may include a number of shelves positioned within the enclosure. The shelves may be gravity feed slides, rotating coils, or drop mechanisms. The vending mechanism may include a selection device and a payment device.

Other features of the present invention will become apparent upon review of the following detailed description of the preferred embodiments of the invention, when taken in conjunction with the drawings and the appended claims.

DETAILED DESCRIPTION OF THE INVENTION

Figure 1:
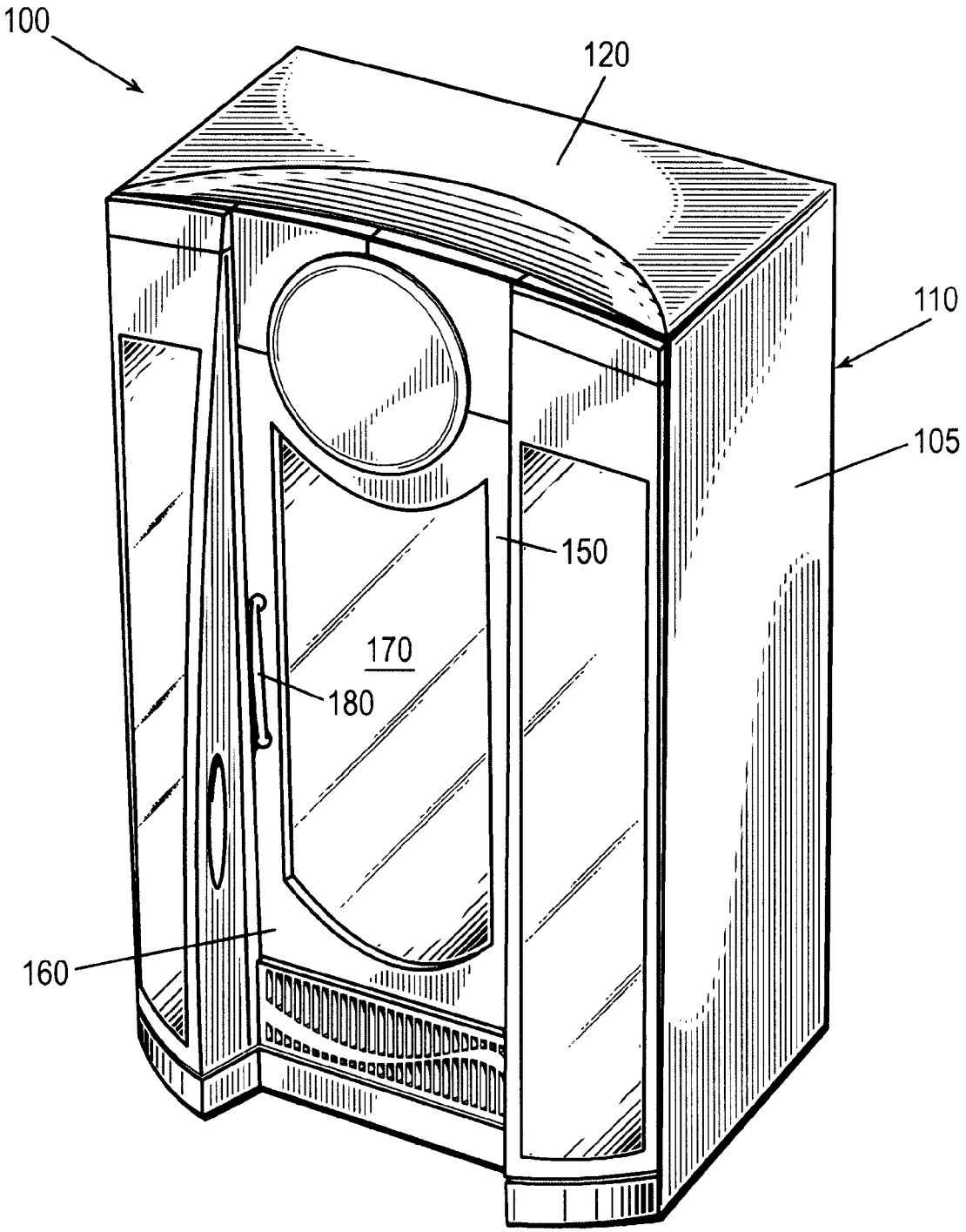
FIG. 1 is a perspective view of a dispensing device of the present invention.
Figure 2:
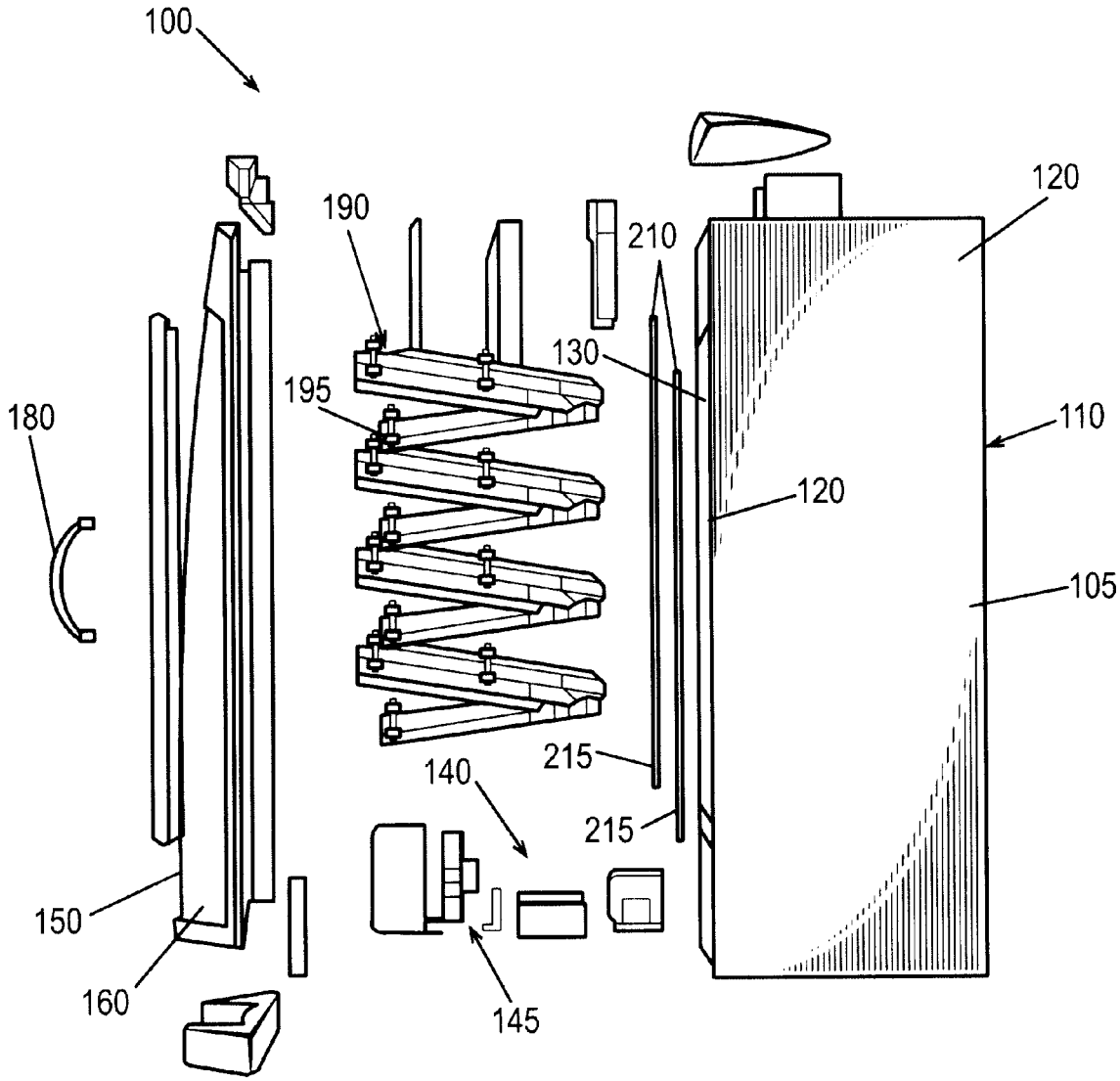
FIG. 2 is a side exploded view of the dispensing device of FIG. 1.
Figure 2A:
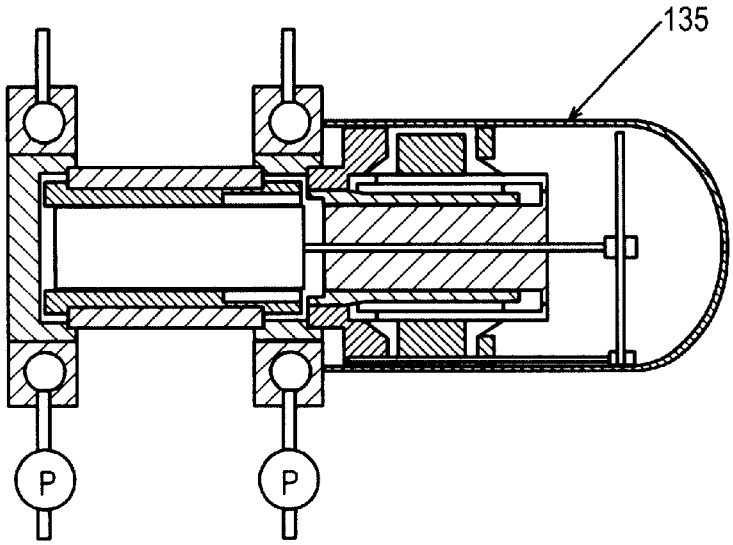
FIG. 2A is a Stirling cycle cooler useful with the present invention.

Referring now in more detail to the drawings, in which like numerals refer to like elements throughout the several views, FIGS. 1 and 2 show a dispensing device 100 of the present invention. The dispensing device 100 may include any type of enclosure 105. In this embodiment, the dispensing device 100 may be in the form of a refrigerator or a cooler 110. The scope of the invention, however, is not in any way limited by the scope or nature of the enclosure 105. The cooler 110 may have an insulated shell 120 enclosing an interior portion 130. The insulated shell 120 may be made from a conventional combination of metals, foams, plastics, or similar types of materials. The insulated shell 120 may be largely of conventional design. Although a substantially rectangular shape is shown, any convenient shape, size, or capacity may be used. The cooler 110, the insulated shell 120, and the other components of the dispensing device 100 of the present invention may be similar to that sold by the Beverage-Air Company of Spartanburg, S.C. with coolers under the mark "Marketeer".

The cooler 110 may have a heat transfer system 140 positioned therein or adjacent thereto so as to chill the interior portion 130. The heat transfer system 140 may be a Stirling cycle system 135 a conventional Rankine cycle system 145, a Transcritical Carbon Dioxide cycle device, or any other type of refrigeration system. A Stirling cycle cooler useful in the present invention is shown in commonly owned U.S. Pat. Nos. 6,266,963 and 6,272,867, incorporated herein by reference. Alternatively, the heat transfer system 140 may transport heat to the interior portion 130 so as to warm the interior portion 140 in a conventional manner. The heat transfer system 140 also may heat one part of the interior portion 130 while chilling another part. The scope of the invention, however, is not in any way limited by the scope or nature of the heat transfer system 140.

One or more doors 150 may enclose the insulated shell 120. The door(s) 150 may be insulated in a conventional manner. Each door 150 may include an outer frame 160 and one or more substantially transparent panels 170. The outer frame 160 may be made from metals, plastics, or similar types of materials. The transparent panel 170 may be made from single or multiple paned glass or any other type of substantially transparent materials with good insulating capabilities. For example, polycarbonate, ABS (acrylonitrile-butadiene-styrene), or other suitable materials may be used. A handle 180 or a similar device may be used to open the door 150.

Positioned within the interior portion 130 of the cooler 110 may be a plurality of shelves 190. The shelves 190 may be conventional flat shelves, gravity feed slides 195, rotating coils, other types of drop mechanisms, or any other type of product support or product feeding system. Further, any combination of these elements may be used together. Positioned on the shelves 190 may be a plurality of products 200. The products 200 may be in the shape of a bottle, a can, a pouch, a box, a carton, a package, a wrapper, or any other type of product container or configuration. The products 200 may be any type of object that may be sold in a dispensing device, including but not limited to any type of object that is generally heated or chilled prior to dispensing. The scope of the invention is not in any way limited by the scope or nature of the products 200. Each of the products 200 may include an indication of source 205, such as a label or other type of product and/or brand identification.

The interior portion 130 of the cooler 110 may have one or more light emitting diodes ("LED's") 210 positioned therein. The LED's 210 may be positioned adjacent to the door 150 or elsewhere within the cooler 110. The LED's 210 may serve to illuminate the interior portion 130 of the cooler 110 and the products 200 positioned therein.

The LED's 210 may have a significantly longer lifetime than fluorescent lighting or other types of conventional lighting sources. For example, it may be expected for the LED's 210 to last as long as the refrigeration system 140 or even the cooler 110 itself. As such, there is generally no replacement costs involved in the long-term use of the LED's. Further, the LED's 210 generally require very little maintenance, if any.

Not only may the LED's 210 have a significant lifetime, the LED's 210 generally require much less energy to operate than conventional lighting sources. The LED's 210 also produce very little heat. As such, the overall efficiency of the cooler 110 may increase. In fact, the use of the LED's 210 may decrease the energy demands of the cooler 110 as a whole.

The LED's 210 generally may be smaller in size than conventional fluorescent lighting fixtures. Despite this smaller size, the use of the LED's 210 may provide a significant increase in brightness and clarity as compared to conventional lighting techniques. The LED's 210 also may provide various colors, such as blue, red, and green, that may be used separately or together. A preferred LED 210 may be manufactured by Color Kinetics of Boston, Mass. under the mark "ChromaCore". Each LED 210 may be a type T1.75 inch (500 millimeters) with a luminous intensity of about 5.6 Candela and a directivity of about twenty (20) degrees. The LED's 210 described herein also may be used in combination with conventional lighting sources.

In this example, the LED's 210 may be arranged in a tube-like bundle 215. Each LED bundle 215 may have a diameter of about 0.75 to about 1.25 inches (about 1.9 to about 3.2 millimeters) and a length of about 1 to about 3 feet (about 0.3 to about 0.9 meters). Each LED bundle 215 may have about 18 to 54 LED's 210 therein. Each LED 210 may have a power consumption of about 0.14 Watt such that each LED bundle 215 may have a LED 210 power consumption of about 2.5 to about 7.5 Watts. A LED bundle 215 useable with the present invention may be sold by Advanced Lighting, Inc. of Ormond Beach, Fla., under the mark "E-Stars Nova Series" Mono-Chromatic LED Light Strips and under other marks.

Figure 3:
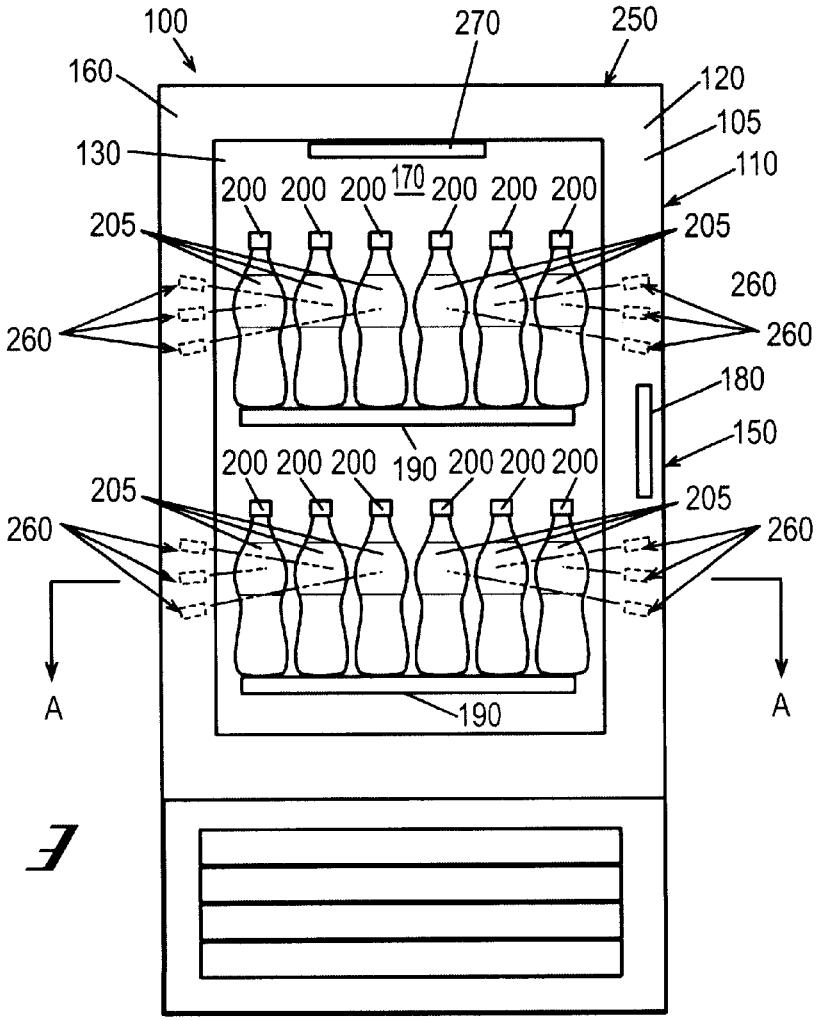
FIG. 3 is a front plan view of an alternative dispensing device of the present invention with the directional LED's shown in phantom lines.
Figure 4:
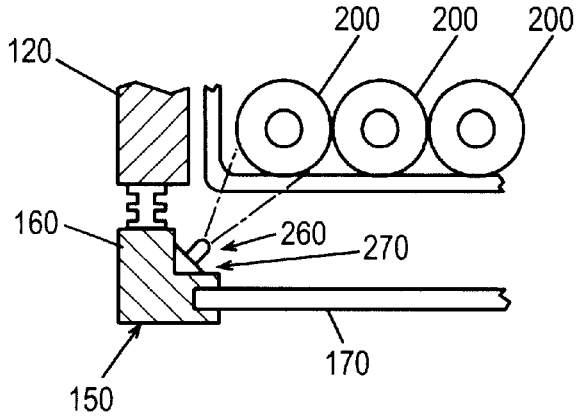
FIG. 4 is a partial top cross-sectional view of the dispensing device of FIG. 3 taken along line A—A.

FIGS. 3 and 4 show an alternative embodiment of the product dispensing device 100 of the present invention. This embodiment shows a cooler 250. The cooler 250 may be substantially identical to the cooler 110 described above. Rather than the having the LED's 210 being positioned generally within the interior portion 130, this embodiment employs the use of a number of directional LED's 260. As the name implies, the directional LED's 260 may tightly focus their light in a particular direction in a manner similar to a small spotlight or flashlight. A number of directional LED's 260 may be bundled together so as to provide a sufficient amount of lighting and/or brightness.

The individual directional LED's 260 may be identical to the individual LED's 210 described above. Each directional LED 260 may have a power consumption of about 0.14 Watt such that the cooler 250 with about 18 to 54 directional LED's 260 may have a directional LED 260 power consumption of about 2.5 to about 7.5 Watts. Each directional LED 260 may be a type T1.75 inch (500 millimeters) with a luminous intensity of about 5.6 Candela and a directivity of about twenty (20) degrees.

The directional LED's 260 may be positioned within the doorframe 160, on the shelves 190, or positioned otherwise within the interior portion 130 of the cooler 110. Specifically, the directional LED's 260 may be positioned anywhere within the cooler 110. Each directional LED 260 may be mounted upon a mounting block 270. The mounting block 270 provides that each of the directional LED's 260 may be positioned so as to illuminate a particular product 200 within the interior portion 130 or simply a particular location within the interior portion 130. For example, the directional LED's 260 may be targeted so as to illuminate specifically the source indication 205 or other product identification information found on each product 200. More than one directional LED 260 or a combination of directional LED's 260 may be used for each product 200. The directional LED's 260 may be adjustable so as to change the direction and/or the focus of the light beam or beams as desired. The position of each directional LED 260 also may be changed.

The cooler 250 thus may use the directional LED's 260 to illuminate the products 200 as opposed to illuminating all of the interior portion 130 of the cooler 110 as is done with conventional fluorescent lighting. Each directional LED's 260 may be positioned, directed, and focused as desired. For example, the directional LED's 260 may be focused on particular products 200 or areas within the interior portion 130 of the cooler 110. Alternatively, the directional LED's 260 may be focused on just the source indication 205 of the products 200. The net result should be a net reduction in energy usage and an increase in overall energy efficiency. Further, the directional LED's 260 may be used in combination with the LED's 210 described above or with a conventional fluorescent lighting source 270 so as to highlight selectively certain products 200 or certain areas within the interior portion 130 of the cooler 110 while the fluorescent lighting sources 270 provide general or background lighting.

Figure 5:
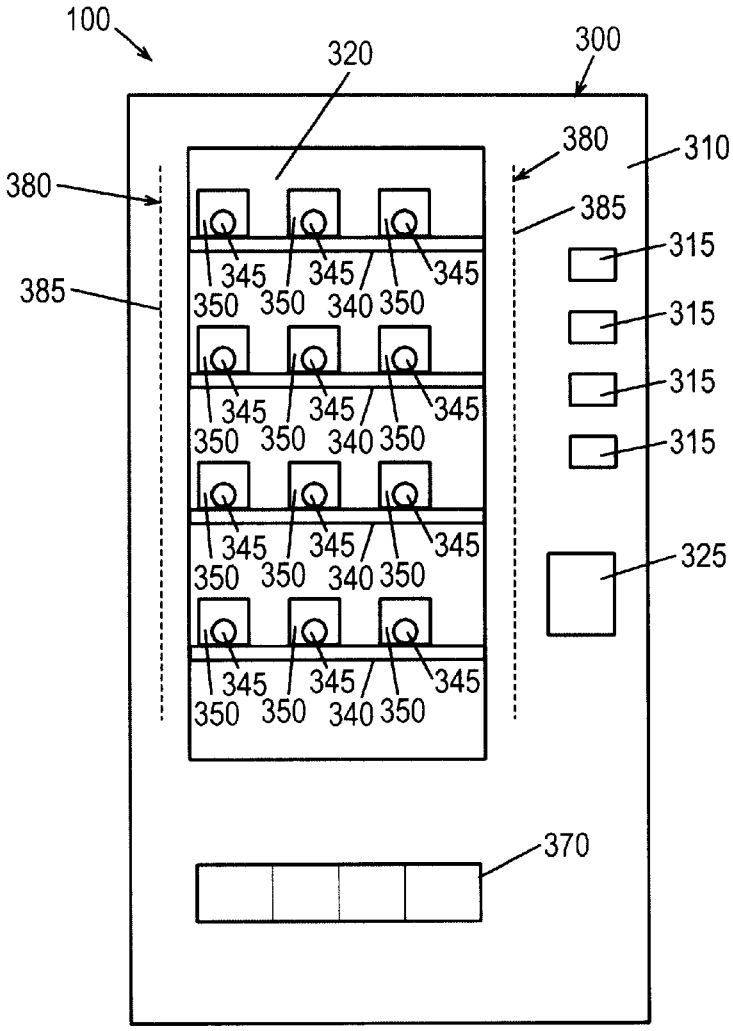
FIG. 5 is a front plan view of an alternative embodiment of the dispensing device of the present invention with the LED's shown in phantom lines.

FIG. 5 shows a further alternative embodiment of the dispensing device 100. This embodiment shows a glass front vendor 300 or a similar type of conventional vending machine of the present invention. Specifically, the glass front vendor 300 may be largely of conventional design. The glass front vendor 300 may include an outer shell 310. The outer shell 310 may define an interior portion 320. The outer shell 310 also generally may include one or more front panels 330. The front panel(s) 330 may be made from single or multiple paned glass or any other type of transparent materials. For example, polycarbonate, ABS, or other suitable materials may be used. Side or lateral panels also may be used. The glass front vendor 300 may or may not include a heat transfer system 140 such as that described above. The scope of the invention is not limited by the scope or the nature of the glass front vendor 300.

The interior portion 320 of the glass front vendor 300 also may include a plurality of shelves 340. The shelves 340 may be the gravity feed slides 195 as shown in FIG. 2, a plurality of rotating coils 345, other types of drop mechanisms, or any other type of product support or product feeding system. A plurality of products 350 may be positioned on the shelves 340. The products 350 may be any type of object that is normally sold in a dispensing device similar to or identical to those products 200 described above. Also as described above, the products 350 may have one or more types of identification indication of source 360 positioned thereon.

The shell 310 of the glass front vendor 300 also may have a vending area 370. The vending area 370 may have a number of bins, trays, slots, or other types of conventional product collection or drop spaces so as to permit the consumer to receive and remove the products 350 as they are selected and dispensed therein. The glass front vendor 300 also may have typical vending devices such as a selection mechanism 315, a payment mechanism 325, and other typical vending machine components of conventional design and operation.

As is shown in phantom lines, the glass front vendor 300 may have one or more LED's 380 positioned within the interior space 320. As with the cooler 110, the LED's 380 may be in the form of a LED bundle 385 and may be positioned about the panel 330 so as to provide illumination to the products 350 therein. The LED's 380 may generally illuminate the interior portion 320. The LED's 380 and the LED bundles 385 may be similar or identical to the LED's 210 and the LED bundles 215 described above. Likewise, the positioning and use of the LED's 380 and the LED bundles 385 may be similar or identical to that described above. The LED's 380 and the LED bundles 385 may be used in combination with the traditional lighting sources 270 so as to highlight selectively certain products 350 or certain areas within the interior portion 320 of the glass front vendor 300.

Figure 6:
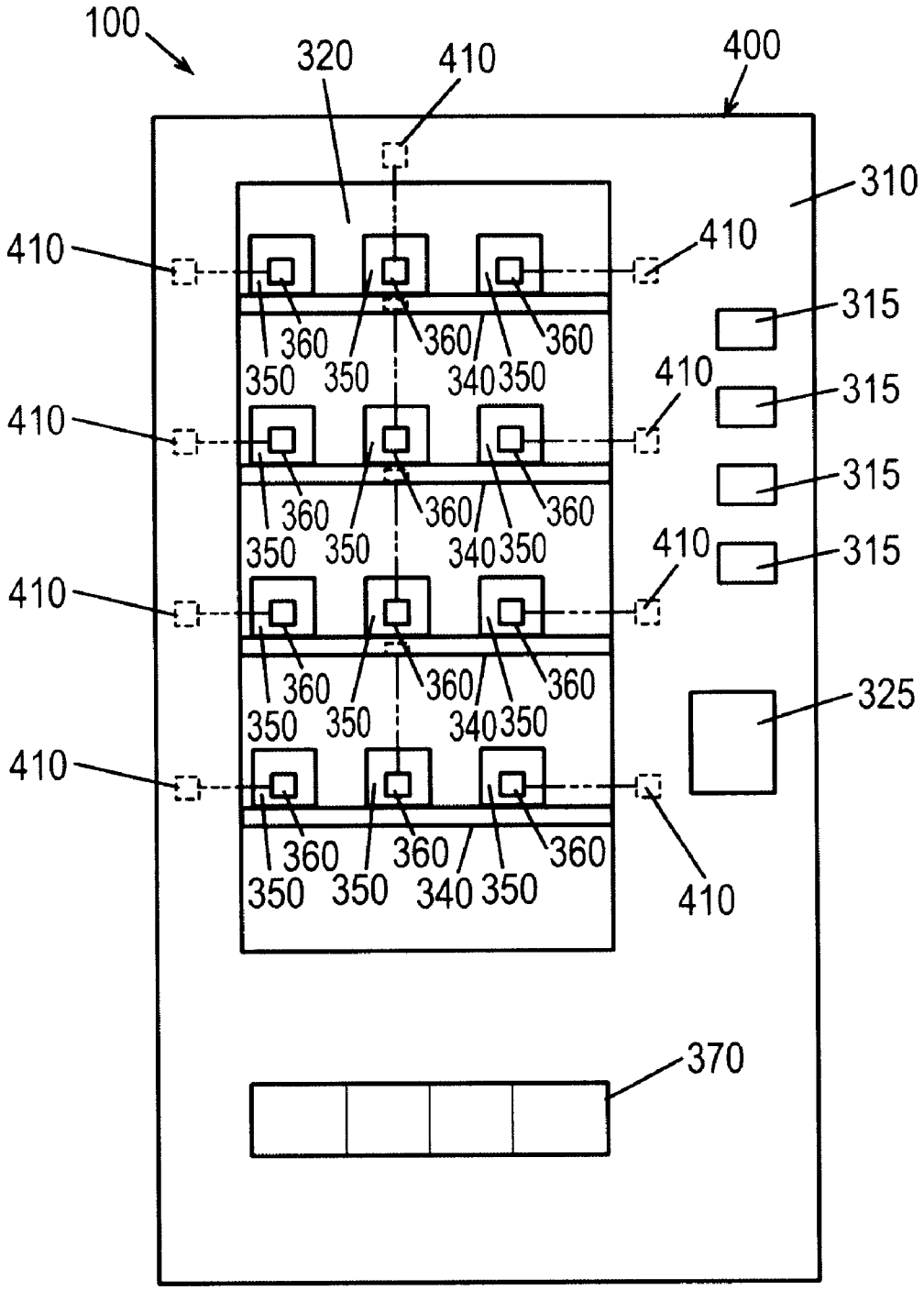
FIG. 6 is a front plan view of an alternative embodiment of the dispensing device of the present invention with the directional LED's shown in phantom lines.

FIG. 6 shows a further embodiment of the dispensing device 100 of the present invention. This embodiment shows an alternative glass front vendor 400. The glass front vendor 400 may be substantially identical to the glass front vendor 300 described above. Instead or in addition to the LED's 380, however, the glass front vendor 400 may use a number of directional LED's 410 similar to those used in the cooler 250 described above.

The directional LED's 410 may be mounted about the panel 330, on the mounting block 270, on the shelves 340, or in any part of the interior portion 320 of the glass front vendor 400. The directional LED's 410 may be positioned on the shelves 340 so as to illuminate the products 350 from above or below. The directional LED's 410 also may be positioned so as to illuminate the products 350 and/or their identification indication of source 360. The directional LED's 410 also may be adjusted to illuminate any desired part of the interior portion 320. The directional LED's 410 may be similar or identical to the directional LED's 260 described above. Likewise, the positioning and use of the directional LED's 410 may be similar or identical to that described above. Further, the directional LED's 410 may be used in combination with the LED's 380 described above or with the traditional lighting sources 270 so as to highlight selectively certain products 350 or certain areas within the interior portion 320 of the glass front vendor 400.

It should be apparent that the foregoing relates only to the preferred embodiments of the present invention and that numerous changes and modifications may be made herein without departing from the spirit and scope of the invention as defined by the following claims and the equivalents thereof.

I claim:

1. A device for providing a number of products, comprising:

an enclosure; and a plurality of directional light emitting diodes positioned within said enclosure for illuminating one or more of the number of products.

2. The device of claim 1, wherein one or more of said plurality of directional light emitting diodes comprise a directivity of about twenty (20) degrees.

3. The device of claim 1, wherein one or more of said plurality of directional light emitting diodes comprise a luminous intensity of about five (5) to six (6) Candela.

4. The device of claim 1, wherein said enclosure comprises a plurality of shelves for the number of products.

5. The device of claim 4, wherein one or more of said plurality of directional light emitting diodes are positioned on one or more of said plurality of shelves.

6. The device of claim 1, wherein said enclosure comprises a doorframe.

7. The device of claim 6, wherein one or more of said plurality of directional light emitting diodes are positioned on said doorframe.

8. The device of claim 1, wherein said enclosure comprises one or more mounting blocks.

9. The device of claim 8, wherein one or more of said plurality of directional light emitting diodes are positioned on said one or more mounting blocks.

10. The device of claim 1, wherein the number of products each comprise an indication of source and wherein one or more of said plurality of directional light emitting diodes are directed at said indication of source of one or more of the number of products.

11. The device of claim 1, wherein said plurality of directional light emitting diodes comprises a plurality of adjustable light emitting diodes.

12. The device of claim 1, further comprising a plurality of light emitting diodes positioned within said enclosure.

13. The device of claim 1, further comprising a florescent light source positioned within said enclosure.

14. A dispensing device for providing a number of products, comprising:

an enclosure;

a heat transfer system positioned in communication with said enclosure; and a plurality of directional light emitting diodes positioned in communication with said enclosure to illuminate a selected number of the number of products.

15. The dispensing device of claim 14, wherein said heat transfer system comprises a Stirling cycle device.

16. The dispensing device of claim 14, wherein one or more of said plurality of light emitting diodes comprise a brightness of about 1000 to about 3000 Lumens.

17. The dispensing device of claim 14, further comprising a plurality of shelves positioned within said enclosure for the number of products.

18. The dispensing device of claim 17, wherein said plurality of shelves comprises gravity feed slides.

19. The dispensing device of claim 14, further comprising a fluorescent light source positioned within said enclosure.

20. A dispensing device for providing a number of products, comprising:

an enclosure;

a heat transfer system positioned in communication with said enclosure; and a plurality of directional light emitting diodes positioned in communication wit said enclosure to illuminate a selected number of the number of products.

21. A dispensing device for providing a number of products, comprising:

an enclosure;

said enclosure comprising a transparent panel;

a vending mechanism positioned in communication with said enclosure; and a plurality of directional light emitting diodes positioned within said enclosure to illuminate the number of products.

22. The dispensing device of claim 21, wherein said plurality of directional light emitting diodes comprises a plurality of light emitting diode bundles.

23. The dispensing device of claim 21, further comprising a plurality of shelves positioned within said enclosure for the number of products.

24. The dispensing device of claim 23, wherein said plurality of shelves comprises gravity feed slides.

25. The dispensing device of claim 21, wherein said vending mechanism comprises a selection device.

26. The dispensing device of claim 21, wherein said vending mechanism comprises a payment device.

* * * * *